US005843877A

United States Patent [19]

Park et al.

[11] Patent Number: 5,843,877

[45] Date of Patent: Dec. 1, 1998

[54] MACHINE DISHWASHING COMPOSITIONS CONTAINING AN OXYGEN BLEACH AND A BISMUTH SALT TO REDUCE SILVER TARNISHING

[75] Inventors: John Scott Park, Tyne & Wear; Elizabeth Ann Shaw, Hartford Dale; Barry Stoddart, Tyne & War, all of Great Britain

[73] Assignee: The Procter & Gamble Company, Cincinnatti, Ohio

[21] Appl. No.: 776,513

[22] PCT Filed: Jan. 5, 1996

[86] PCT No.: PCT/US96/00262

§ 371 Date: Jul. 21, 1997

§ 102(e) Date: Jul. 21, 1997

[87] PCT Pub. No.: WO96/22348

PCT Pub. Date: Jul. 25, 1996

[30] Foreign Application Priority Data

Jan. 20, 1995 [GB] United Kingdom ..... 9501156

[51] Int. Cl.[6] ..... C11D 3/395; C11D 7/18; C11D 7/54; C11D 7/60

[52] U.S. Cl. ..... 510/220; 510/255; 510/367; 510/375; 510/401

[58] Field of Search ..... 510/220, 508, 510/514, 367, 372, 375, 255, 401; 252/400.54

[56] References Cited

U.S. PATENT DOCUMENTS

| | | | |
|---|---|---|---|
| 2,425,907 | 8/1947 | Wegst et al. | 252/156 |
| 2,829,103 | 4/1958 | Ruff et al. | 252/135 |
| 2,997,421 | 8/1961 | Hosmer et al. | 167/17 |
| 4,219,436 | 8/1980 | Gromer et al. | 252/135 |
| 4,443,270 | 4/1984 | Biard et al. | 134/25.2 |
| 4,620,936 | 11/1986 | Kielman et al. | 252/99 |
| 5,374,369 | 12/1994 | Angevaare et al. | 252/102 |
| 5,520,835 | 5/1996 | Sivik et al. | 252/102 |
| 5,534,180 | 7/1996 | Miracle et al. | 510/220 |
| 5,578,136 | 11/1996 | Taylor et al. | 139/25.2 |
| 5,599,781 | 2/1997 | Haeggberg et al. | 510/220 |
| 5,646,101 | 7/1997 | MacBeath | 510/220 |
| 5,695,679 | 12/1997 | Christie et al. | 252/186.26 |
| 5,698,504 | 12/1997 | Christie et al. | 510/220 |
| 5,703,030 | 12/1997 | Perkins et al. | 510/311 |
| 5,705,464 | 1/1998 | Scheper et al. | 510/221 |

FOREIGN PATENT DOCUMENTS 1586067 3/1981 United Kingdom .

OTHER PUBLICATIONS

U.S. application No. 08/569,070, Christie et al., filed Aug. Dec. 21, 1995.

U.S. application No. 08/496,836, Christie et al., filed Jun. 29, 1995.

U.S. application No. 08/583,105, Christie et al., filed Mar. 19, 1996.

*Primary Examiner*—Paul Lieberman

*Assistant Examiner*—John M. Petruncio

*Attorney, Agent, or Firm*—Jacobus C. Rasser; Ken K. Patel; Pankaj M. Khosla

[57] ABSTRACT

There is provided a composition adapted for use in machine dishwashing having reduced silver-tarnishing, as well as good cleaning performance. The composition contains an oxygen bleach and a water-soluble bismuth compound.

13 Claims, No Drawings

MACHINE DISHWASHING COMPOSITIONS CONTAINING AN OXYGEN BLEACH AND A BISMUTH SALT TO REDUCE SILVER TARNISHING

TECHNICAL FIELD

The present invention relates to oxygen-bleach containing compositions, adapted for use in machine dishwashing, exhibiting good bleachable stain removal and reduced silver-tarnishing properties.

BACKGROUND TO THE INVENTION

Compositions designed for use in automatic dishwasher machines are well known, and a consistent effort has been made by detergent manufacturers to improve the cleaning and/or rinsing efficiency of said compositions on chinaware, glassware and silverware, as reflected by numerous patent publications.

The satisfactory removal of bleachable soils such as tea, fruit juice and coloured vegetable soils, such as carotenoid soils is a particular challenge to the formulator of a machine dishwashing composition. Traditionally, the removal of such soils has been enabled by the use of bleach components such as oxygen and chlorine bleaches.

A problem encountered with the use of oxygen bleaches, in particular, is the tarnishing of any silverware components of the washload. Chlorine bleaches can under certain circumstances give rise to silver tarnishing, but the problem is significantly less pronounced than that arising from the use of oxygen bleaches. The level of tarnishing observed with oxygen bleaches can range from slight discolouration of the silverware to the formation of a dense black coating on the surface of the silverware.

The formulator thus faces the dual challenge of formulating an oxygen bleach containing product which maximises bleachable soil cleaning but minimises the occurrence of tarnishing of silverware components of the washload.

It has been surprisingly found that reduced silver tarnishing as well as good cleaning performance can be achieved through the inclusion in an oxygen bleach containing formulation of a water-soluble bismuth compound.

It has also been found that the presence of water-soluble sulphate salts surprisingly enhances the silver tarnish inhibition capability of the bismuth compound.

To further reduce the occurence of silver tarnishing, the rate of release of the oxygen bleach is preferably also controlled. The rate of release of oxygen bleach is preferably rapid enough to provide satisfactory cleaning, but not so rapid that tarnishing is enabled.

Compositions having low alkalinity, and in particular those having alkalinity systems including a minor proportion of a metasilicate component are preferred, as are compositions having a pH which is not unduly high.

UK Patent Specification No. 1,586,067 in the name of the Procter and Gamble Company, discloses automatic dishwashing compositions containing bismuth salts to provide protection to china overglaze without any negative glassware irridescence effects. It is taught therein that chlorine bleaching agents are preferable components of these compositions and specific examples of chlorine containing compositions are given. The use of oxygen bleaches in such compositions is not disclosed. The problem of silver tarnishing is not addressed by this document, nor is any teaching provided of the use of bismuth salts as silver tarnish inhibition agents.

In another aspect it has been found that treatment of silverware with a composition containing bismuth prior to washing in a machine dishwashing method using an oxygen bleach-containing detergent can also reduce the tendency of that silverware to tarnish during the wash.

In a further aspect it has been found that the provision of a means of delivering bismuth to a machine silverware washing/bleaching solution separate from the bleaching/detergent composition employed therein can also lead to a reduction in the tendency for tarnishing to occur. Said means may comprise some kind of a bismuth ion delivery system placed inside a dishwasher machine which is designed to allow release of bismuth ions during the course of the washing process.

It is an object of the present invention to provide compositions, suitable for use in machine dishwashing methods, having reduced silver-tarnishing properties, as well as good cleaning performance, particularly bleachable soil removal performance.

SUMMARY OF THE INVENTION

There is provided a composition, adapted for use in a machine dishwashing method, containing (a) an oxygen-releasing bleaching system; and (b) a water-soluble bismuth compound.

In a preferred aspect the composition also contains a water-soluble sulphate salt.

According to another aspect there is provided the use of a composition containing a water-soluble bismuth compound for the pretreatment of silverware prior to submitting it to a machine dishwashing method employing an oxygen bleach-containing composition.

In still another aspect there is provided the use of a means of delivery of bismuth ions to a machine dishwashing solution containing an oxygen bleach, wherein said means is not the bleaching/detergent composition employed therein.

DETAILED DESCRIPTION OF THE INVENTION

The present compositions contain as essential components an oxygen-releasing bleach and a water soluble bismuth salt.

Machine Dishwashing Compositions

The compositions herein are adapted for use in a machine dishwashing method. Such compositions are formulated to enable the removal of, typically food based, soils and stains from soiled tableware under the conditions present in a machine dishwasher. Typically the compositions are low foaming, preferably containing only low levels of low-foaming surfactants.

Oxygen-Releasing Bleaching System

The first essential feature of the compositions of the invention is an oxygen-releasing bleaching system. In one preferred aspect the bleaching system contains a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches. In an alternative preferred aspect a preformed organic peroxyacid is incorporated directly into the composition. Compositions containing mixtures of a hydrogen peroxide source and organic peroxyacid precursor in combination with a preformed organic peroxyacid are also envisaged.

Inorganic Perhydrate Bleaches

The compositions in accord with the invention preferably include a hydrogen peroxide source, as an oxygen-releasing bleach. Suitable hydrogen peroxide sources include the inorganic perhydrate salts.

The inorganic perhydrate salts are normally incorporated in the form of the sodium salt at a level of from 1% to 40% by weight, more preferably from 2% to 30% by weight and most preferably from 5% to 25% by weight of the compositions.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product.

Sodium perborate can be in the form of the monohydrate of nominal formula $NaBO_2H_2O_2$ or the tetrahydrate $NaBO_2H_2O_2.3H_2O$.

Alkali metal percarbonates, particularly sodium percarbonate are preferred perhydrates for inclusion in compositions in accordance with the invention. Sodium percarbonate is an addition compound having a formula corresponding to $2Na_2CO_3.3H_2O_2$, and is available commercially as a crystalline solid. Sodium percarbonate, being a hydrogen peroxide addition compound tends on dissolution to release the hydrogen peroxide quite rapidly which can increase the tendency for localised high bleach concentrations to arise. The percarbonate is most preferably incorporated into such compositions in a coated form which provides in product stability.

A suitable coating material providing in product stability comprises mixed salt of a water soluble alkali metal sulphate and carbonate. Such coatings together with coating processes have previously been described in GB-1,466,799, granted to Interox on 9th Mar. 1977. The we the mixed salt coating material to percarbonate lies in the range from 1: 200 to 1:4, more preferably from 1:99 to 1:9, and most preferably from 1:49 to 1:19. Preferably, the mixed salt is of sodium sulphate and sodium carbonate which has the general formula $Na_2SO_4.n.Na_2CO_3$ wherein n is from 0.1 to 3, preferably n is from 0.3 to 1.0 and most preferably n is from 0.2 to 0.5.

Other coatings which contain silicate (alone or with borate salts or boric acids or other inorganics), waxes, oils, fatty soaps can also be used advantageously within the present invention.

Potassium peroxymonopersulfate is another inorganic perhydrate salt of utility in the compositions herein.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

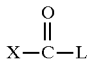

where L is a leaving group and X is essentially any functionality, such that on perhydroloysis the structure of the peroxyacid produced is

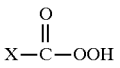

Peroxyacid bleach precursor compounds are preferably incorporated at a level of from 0.5% to 20% by weight, more preferably from 1% to 10% by weight, most preferably from 1.5% to 5% by weight of the compositions.

Suitable peroxyacid bleach precursor compounds typically contain one or more N—or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching composition.

Preferred L groups are selected from the group consisting of:

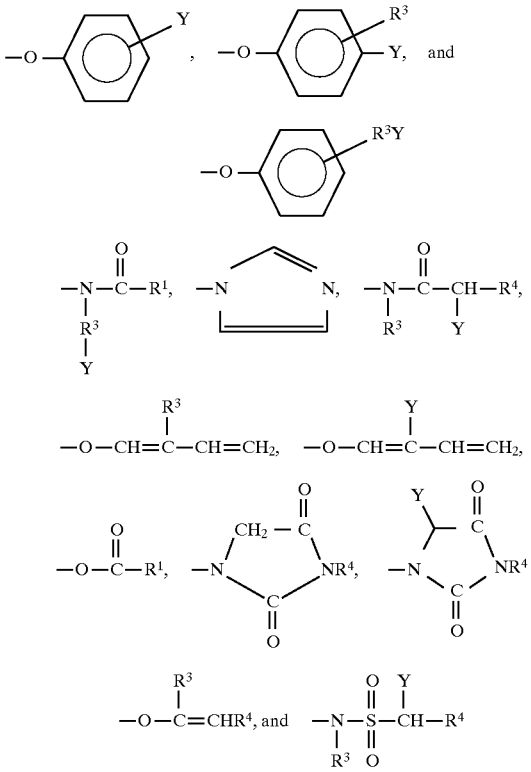

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammmonium groups The preferred solubilizing groups are $—SO_3^-M^+$, $—CO_2^-M^+$, $—SO_4^-M^+$, $—N^+(R^3)_4X^-$ and $O<—N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Perbenzoic Acid Precursor

Perbenzoic acid precursor compounds provide perbenzoic acid on perhydrolysis.

Suitable O-acylated perbenzoic acid precursor compounds include the substituted and unsubstituted benzoyl oxybenzene sulfonates, including for example benzoyl oxybenzene sulfonate:

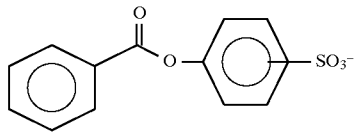

Also suitable are the benzoylation products of sorbitol, glucose, and all saccharides with benzoylating agents, including for example:

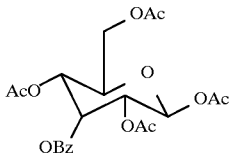

Ac=COCH3; Bz=Benzoyl

Perbenzoic acid precursor compounds of the imide type include N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole and other useful N-acyl group-containing perbenzoic acid precursors include N-benzoyl pyrrolidone, dibenzoyl taurine and benzoyl pyroglutamic acid.

Other perbenzoic acid precursors include the benzoyl diacyl peroxides, the benzoyl tetraacyl peroxides, and the compound having the formula:

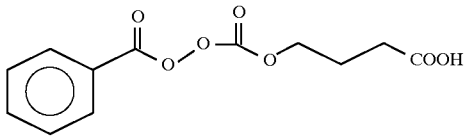

Phthalic anhydride is another suitable perbenzoic acid precursor compound herein:

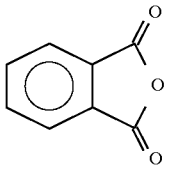

Suitable N-acylated lactam perbenzoic acid precursors have the formula:

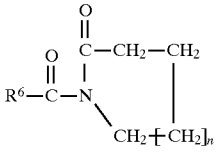

wherein n is from 0 to 8, preferably from 0 to 2, and $R^6$ is a benzoyl group.

Perbenzoic acid derivative precursors

Perbenzoic acid derivative precursors provide substituted perbenzoic acids on perhydrolysis. Suitable substituted perbenzoic acid derivative precursors include any of the herein disclosed perbenzoic precursors in which the benzoyl group is substituted by essentially any non-positively charged (ie; non-cationic) functional group including, for example alkyl, hydroxy, alkoxy, halogen, amine, nitrosyl and amide groups.

A preferred class of substituted perbenzoic acid precursor compounds are the amide substituted compounds of the following general formulae:

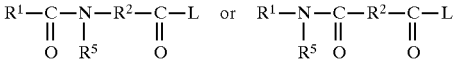

wherein $R^1$ is an aryl or alkaryl group with from 1 to 14 carbon atoms, $R^2$ is an arylene, or alkarylene group containing from 1 to 14 carbon atoms, and $R^5$ is H or an alkyl, aryl, or alkaryl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be aryl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Cationic Peroxyacid Precursors

Cationic peroxyacid precursor compounds produce cationic peroxyacids on perhydrolysis.

Typically, cationic peroxyacid precursors are formed by substituting the peroxyacid part of a suitable peroxyacid precursor compound with a positively charged functional group, such as an ammonium or alkyl ammmonium group, preferably an ethyl or methyl ammonium group. Cationic peroxyacid precursors are typically present in the compositions as a salt with a suitable anion, such as for example a halide ion or a methylsulfate ion.

The peroxyacid precursor compound to be so cationically substituted may be a perbenzoic acid, or substituted derivative thereof, precursor compound as described hereinbefore. Alternatively, the peroxyacid precursor compound may be an alkyl percarboxylic acid precursor compound or an amide substituted alkyl peroxyacid precursor as described hereinafter Cationic peroxyacid precursors are described in U.S. Pat. Nos. 4,904,406; 4,751,015; 4,988,451; 4,397,757; 5,269,962; 5,127,852; 5,093,022; 5,106,528; U.K. 1,382,594; EP 475,512, 458,396 and 284,292; and in JP 87-318,332.

Examples of preferred cationic peroxyacid precursors are described in UK Patent Application No. 9407944.9 (attorney's docket no. CM642F) and U.S. patent application Ser. Nos. 08/298903, 08/298650, 08/298904 and 08/298906 (attorney's docket no.s 5413 to 5416).

Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides.

A preferred cationically substituted benzoyl oxybenzene sulfonate is the 4-(trimethyl ammonium) methyl derivative of benzoyl oxybenzene sulfonate:

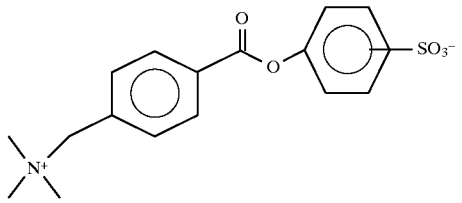

A preferred cationically substituted alkyl oxybenzene sulfonate has the formula:

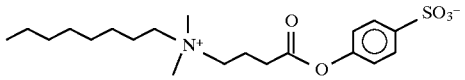

Preferred cationic peroxyacid precursors of the N-acylated caprolactam class include the trialkyl ammonium methylene benzoyl caprolactams, particularly trimethyl ammonium methylene benzoyl caprolactam:

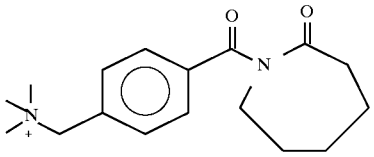

Other preferred cationic peroxyacid precursors of the N-acylated caprolactam class include the trialkyl ammonium methylene alkyl caprolactams:

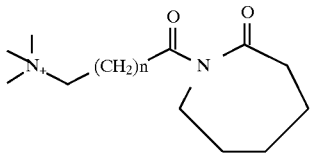

where n is from 0 to 12, particularly from 1 to 5.

Another preferred cationic peroxyacid precursor is 2-(N, N,N-trimethyl ammonium) ethyl sodium 4sulphophenyl carbonate chloride.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the N—,N,$N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide Substituted Alkyl Peroxyacid Precursors

Amide substituted alkyl peroxyacid precursor compounds are also suitable, including those of the following general formulae:

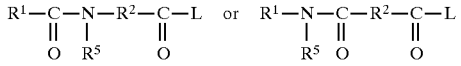

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be straight chain or branched alkyl containing branching, substitution, or both and may be sourced from either synthetic sources or natural sources including for example, tallow fat. Analogous structural variations are permissible for $R^2$. The substitution can include alkyl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Benzoxazin Organic Peroxyacid Precursors

Also suitable are precursor compounds of the benzoxazin-type, as disclosed for example in EP-A-332,294 and EP-A482,807, particularly those having the formula:

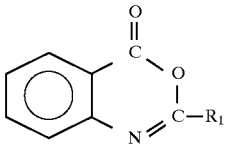

including the substituted benzoxazins of the type

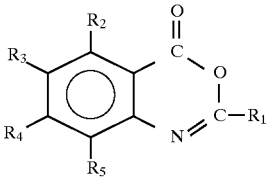

wherein $R_1$ is H, alkyl, alkaryl, aryl, arylalkyl, and wherein $R_2$, $R_3$, $R_4$, and R5 may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

An especially preferred precursor of the benzoxazin-type is:

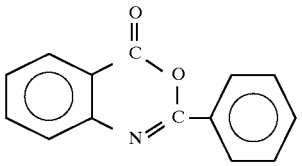

Preformed Organic Peroxyacid

The organic peroxyacid bleaching system may contain, in addition to, or as an alternative to, an organic peroxyacid bleach precursor compound, a preformed organic peroxyacid , typically at a level of from 0.5% to 25% by weight, more preferably from 1% to 10% by weight of the composition.

A preferred class of organic peroxyacid compounds are the amide substituted compounds of the following general formulae:

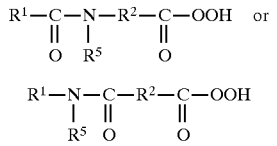

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. $R^1$ preferably contains from 6 to 12 carbon atoms. $R^2$ preferably contains from 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid, and diperoxyhexadecanedioc acid. Dibenzoyl peroxide is a preferred organic peroxyacid herein. Mono- and diperazelaic acid, mono- and diperbrassylic acid, and N-phthaloylaminoperoxicaproic acid are also suitable herein.

Water-Soluble Bismuth Compound

The compositions contain as an essential component a water-soluble bismuth compound, preferably present at a level of from 0.005% to 20%, more preferably from 0.01% to 5%, most preferably from 0.1% to 1% by weight of the compositions.

The water-soluble bismuth compound may be essentially any salt or complex of bismuth with essentially any inorganic or organic counter anion. Preferred inorganic bismuth salts are selected from the bismuth trihalides, bismuth nitrate and bismuth carbonate.

The water-soluble bismuth compound may be a salt or complex of an organic fatty acid such as bismuth acetate or bismuth stearate.

In a preferred aspect the water-soluble bismuth compound comprises a salt or a complex with a chelating organic ligand, that is to say of an organic compound which chelates or-binds metal ions in solution. The binding constant for bismuth of the organic ligand is preferably high enough to ensure the stability of the salt or complex 'in product', but weak enough such that on introduction of the product to a wash solution the bismuth ions are readily released from the salt or complex to the wash solution.

In one preferred execution the organic ligand is a heavy metal ion sequestrant, particularly selected from those heavy metal ion sequestrants described hereinafter, most preferably an organo amino phosphonate. In a further preferred execution the organic ligand is a water-soluble builder compound, particularly selected from those water-soluble builder described compounds hereinafter, such as a phosphate builder or preferably a polycarboxylate builder, most prefereably citrate.

Water-Soluble Sulfate Salt

In a preferred aspect the compositions contain a water-soluble sulfate salt, preferably present at a level of from 0.1% to 40%, more preferably from 1% to 30%, most preferably from 5% to 25% by weight of the compositions.

The water-soluble sulfate salt may be essentially any salt of sulfate with any counter cation. Preferred salts are selected from the sulfates of the alkali and alkaline earth metals, particularly sodium sulfate.

Additional Corrosion Inhibitor Compound

The compositions may contain additional corrosion inhibitors preferably selected from organic silver coating agents, particularly paraffin, nitrogen-containing corrosion inhibitor compounds and Mn(II) compounds, particularly Mn(II) salts of organic ligands.

Organic silver coating agents are described in PCT Publication No. WO94/16047 (attorney's docket no. CM497M) and copending UK Application No. UK 9413729.6 (attorney's docket no. CM750F). Nitrogen-containing corrosion inhibitor compounds are disclosed in copending European Application no. EP 93202095.1 (attorney's docket no. CM571F). Mn(II) compounds for use in corrosion inhibition are described in copending UK Application No. 9418567.5 (attorney's docket no. CM719FM).

Organic Silver Coating Agents

Organic silver coating agent may be incorporated at a level of from 0.05% to 10%, preferably from 0.1% to 5% by weight of the total composition.

The functional role of the silver coating agent is to form 'in use' a protective coating layer on any silverware components of the washload to which the compositions of the invention are being applied. The silver coating agent should hence have a high affinity for attachment to solid silver surfaces, particularly when present in as a component of an aqueous washing and bleaching solution with which the solid silver surfaces are being treated.

Suitable organic silver coating agents herein include fatty esters of mono- or polyhydric alcohols having from 1 to about 40 carbon atoms in the hydrocarbon chain.

The fatty acid portion of the fatty ester can be obtained from mono- or poly-carboxylic acids having from 1 to about 40 carbon atoms in the hydrocarbon chain. Suitable examples of monocarboxylic fatty acids include behenic acid, stearic acid, oleic acid, palmitic acid, myristic acid, lauric acid, acetic acid, propionic acid, butyric acid, isobutyric acid, valeric acid, lactic acid, glycolic acid and β,β'-dihydroxyisobutyric acid. Examples of suitable polycarboxylic acids include: n-butyl-malonic acid, isocitric acid, citric acid, maleic acid, malic acid and succinic acid.

The fatty alcohol radical in the fatty ester can be represented by mono- or polyhydric alcohols having from 1 to 40 carbon atoms in the hydrocarbon chain. Examples of suitable fatty alcohols include; behenyl, arachidyl, cocoyl, oleyl and lauryl alcohol, ethylene glycol, glycerol, ethanol, isopropanol, vinyl alcohol, diglycerol, xylitol, sucrose, erythritol, pentaerythritol, sorbitol or sorbitan.

Preferably, the fatty acid and/or fatty alcohol group of the fatty ester adjunct material have from 1 to 24 carbon atoms in the alkyl chain.

Preferred fatty esters herein are ethylene glycol, glycerol and sorbitan esters wherein the fatty acid portion of the ester normally comprises a species selected from behenic acid, stearic acid, oleic acid, palmitic acid or myristic acid.

The glycerol esters are also highly preferred. These are the mono-, di- or tri-esters of glycerol and the fatty acids as defined above.

Specific examples of fatty alcohol esters for use herein include: stearyl acetate, palmityl di-lactate, cocoyl isobutyrate, oleyl maleate, oleyl dimaleate, and tallowyl proprionate. Fatty acid esters useful herein include: xylitol monopalmitate, pentaerythritol monostearate, sucrose monostearate, glycerol monostearate, ethylene glycol monostearate, sorbitan esters. Suitable sorbitan esters include sorbitan monostearate, sorbitan palmitate, sorbitan monolaurate, sorbitan monomyristate, sorbitan monobehenate, sorbitan mono-oleate, sorbitan dilaurate, sorbitan distearate, sorbitan dibehenate, sorbitan dioleate, and also mixed tallowalkyl sorbitan mono- and di-esters.

Glycerol monostearate, glycerol mono-oleate, glycerol monopalmitate, glycerol monobehenate, and glycerol distearate are preferred glycerol esters herein.

Suitable organic silver coating agents include triglycerides, mono or diglycerides, and wholly or partially hydrogenated derivatives thereof, and any mixtures thereof. Suitable sources of fatty acid esters include vegetable and fish oils and animal fats. Suitable vegetable oils include soy bean oil, cotton seed oil, castor oil, olive oil, peanut oil, safflower oil, sunflower oil, rapeseed oil, grapeseed oil, palm oil and corn oil.

Waxes, including microcrystalline waxes are suitable organic silver coating agents herein. Preferred waxes have a melting point in the range from about 35° C. to about 110° C. and comprise generally from 12 to 70 carbon atoms. Preferred are petroleum waxes of the paraffin and microcrystalline type which are composed of long-chain saturated hydrocarbon compounds.

Alginates and gelatin are suitable organic silver coating agents herein.

Dialkyl amine oxides such as $C_{12}$–$C_{20}$ methylamine oxide, and dialkyl quaternary ammonium compounds and salts, such as the $C_{12}$–$C_{20}$ methylammonium halides are also suitable.

Other suitable organic silver coating agents include certain polymeric materials. Polyvinylpyrrolidones with an average molecular weight of from 12,000 to 700,000, polyethylene glycols (PEG) with an average molecular weight of from 600 to 10,000, polyamine N-oxide polymers, copolymers of N-vinylpyrrolidone and N-vinylimidazole, and cellulose derivatives such as methylcellulose, carboxymethylcellulose and hydroxyethylcellulose are examples of such polymeric materials.

Certain perfume materials, particularly those demonstrating a high substantivity for metallic surfaces, are also useful as the organic silver coating agents herein.

Polymeric soil release agents known to those skilled in the art of formulating laundry detergent compositions can be used as the organic silver coating agent herein.

Suitable polymeric soil release agents include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate, having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, or a combination of (a) and (b).

Typically, the polyoxyethylene segments of (a)(i) will have a degree of polymerization of from about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful herein also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al.

Another suitable soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another suitable polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000.

Another suitable polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink. Other polymeric soil release agents also include the soil release agents of U.S. Pat. No. 4,877,896, issued Oct. 31, 1989 to Maldonado et al, which discloses anionic, especially sulfoarolyl, end-capped terephthalate esters.

Another soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two endcap units of sodium 2-(2-hydroxyethoxy)-ethanesulfonate.

A preferred organic silver coating agent is a paraffin oil, typically a predominantly branched aliphatic hydrocarbon having a number of carbon atoms in the range of from 20 to 50; preferred paraffin oil selected from predominantly branched $C_{25-45}$ species with a ratio of cyclic to noncyclic hydrocarbons of from 1:10 to 2:1, preferably from 1:5 to 1:1. A paraffin oil meeting these characteristics, having a ratio of cyclic to noncyclic hydrocarbons of about 32:68, is sold by Wintershall, Salzbergen, Germany, under the trade name WINOG 70.

Nitrogen-Containing Corrosion Inhibitor Compoudnds

Suitable nitrogen-containing corrosion inhibitor compounds include imidazole a nd derivatives thereof such as benzimidazole, 2-heptadecyl iridazole and those imidazole derivatives described in Czech Patent No.139, 279 and British Patent GB-A-1,137,741, which also discloses a method for making imidazole compounds.

Also suitable as nitrogen-containing corrosion inhibitor compounds are pyrazole compounds and their derivatives, particularly those where the pyrazole is substituted in any of the 1, 3, 4 or 5 positions by substituents $R_1$, $R_3$, $R_4$ and $R_5$ where $R_1$ is any of H, $CH_2OH$, $CONH_3$, or $COCH_3$, $R_3$ and $R_5$ are any of $C_1$–$C_{20}$ alkyl or hydroxyl, and $R_4$ is any of H, $NH_2$ or $NO_2$.

Other suitable nitrogen-containing corrosion inhibitor compounds include benzotriazole, 2-mercaptobenzothiazole, 1-phenyl-5-mercapto-1,2,3,4-tetrazole, thionalide, morpholine, melamine, distearylamine, stearoyl stearamide, cyanuric acid, aminotriazole, aminotetrazole and indazole.

Nitrogen-containing compounds such as amines, especially distearylamine and ammonium compounds such as ammonium chloride, ammonium bromide, ammonium sulphate or diammonium hydrogen citrate are also suitable.

Mn(II) Corrosion Inhibitor Compounds

The compositions may contain an Mn(II) corrosion inhibitor compound. The Mn(II) compound is preferably incorporated at a level of from 0.005% to 5% by weight, more preferably from 0.01% to 1%, most preferably from 0.02% to 0.4% by weight of the compositions. Preferably, the Mn(II) compound is incorporated at a level to provide from 0.1 ppm to 250 ppm, more preferably from 0.5 ppm to 50 ppm, most preferably from 1 ppm to 20 ppm by weight of Mn(II) ions in any bleaching solution.

The Mn (II) compound may be an inorganic salt in anhydrous, or any hydrated forms. Suitable salts include manganese sulphate, manganese carbonate, manganese phosphate, manganese nitrate, manganese acetate and manganese chloride. The Mn(II) compound may be a salt or complex of an organic fatty acid such as manganese acetate or manganese stearate.

The Mn(II) compound may be a salt or complex of an organic ligand. In one preferred aspect the organic ligand is a heavy metal ion sequestrant. In another preferred aspect the organic ligand is a crystal growth inhibitor.

Other corrosion inhibitor compounds

Other suitable additional corrosion inhibitor compounds include, mercaptans and diols, especially mercaptans with 4 to 20 carbon atoms including lauryl mercaptan, thiophenol, thionapthol, thionalide and thioanthranol. Also suitable are saturated or unsaturated $C_{10}$–$C_{20}$ fatty acids, or their salts, especially aluminium tristearate. The $C_{12}$–$C_{20}$ hydroxy fatty acids, or their salts, are also suitable. Phosphonated octadecane and other anti-oxidants such as betahydroxytoluene (BHT) are also suitable.

Copolymers of butadiene and maleic acid, particularly those supplied under the trade reference no. 07787 by Polysciences Inc have been found to be of particular utility as corrosion inhibitor compounds.

Total Available Oxygen (AvO) Level

It has been found that, for optimal anti-silver tarnishing performance, the level of available oxygen in the present compositions, measured in units of % available oxygen by weight of the composition, is preferably controlled; the level of available oxygen should hence preferably be in the range from 0.3% to 2.5%, preferably from 0.5% to 1.7%, more preferably from 0.6% to 1.5%, most preferably from 0.7% to 1.2%, measured according to the method described hereunder.

Rate of Release of AvO

The rate of release of available oxygen is preferably also controlled; the rate of release of available oxygen from the compositions herein preferably should be such that, when using the method described hereinafter, the available oxygen is not completely released from the composition until after 3.5 minutes, preferably the available oxygen is released in a time interval of from 3.5 minutes to 10.0 minutes, more preferably from 4.0 minutes to 9.0 minutes, most preferably from 5.0 minutes to 8.5 minutes.

Method for Measuring Level of Total Available Oxygen (AvO) and Rate of Release of AvO in a Detergent Composition Method 1. A beaker of water (typically 2L) is placed on a stirrer Hotplate, and the stirrer speed is selected to ensure that the product is evenly dispersed through the solution.
2. The detergent composition (typically 8 g of product which has been sampled down from a bulk supply using a Pascal sampler), is added and simultaneously a stop clock is started.
3. The temperature control should be adjusted so as to maintain a constant temperature of 20° C. throughout the experiment. 4. Samples are taken from the detergent solution at 2 minute time intervals for 20 minutes, starting after 1 minute, and are titrated by the "titration procedure" described below to determine the level of available oxygen at each point.

Titration Procedure

1. An aliquot from the detergent solution (above) and 2 ml sulphuric acid are added into a stirred beaker
2. Approximately 0.2 g ammonium molybdate catalyst (tetra hydrate form) are added
3. 3 mls of 10% sodium iodide solution are added
4. Titrabion with sodium thiosulphate is conducted until the end point. The end point can be seen using either of two procedures. First procedure consists simply in seeing the yellow iodine colour fading to clear. The second and preferred procedure consists of adding soluble starch when the yellow colour is becoming faint, turning the solution blue. More thiosulphate is added until the end point is reached (blue starch complex is decolourised).

The level of AvO, measured in units of % available oxygen by weight, for the sample at each time interval corresponds to the amount of titre according to the following equation $$\frac{\text{Vol } S_2O_3 \text{ (ml)} \times \text{Molarity } (S_2O_3) \times 8}{\text{Sample mass (g)}}$$

AvO level is plotted versus time to determine the maximum level of AvO, and the rate of release of AvO Controlled Rate of Release—Means A means may be provided for controlling the rate of release of oxygen bleach to the wash solution.

Means for controlling the rate of release of the bleach may provide for controlled release of peroxide species to the wash solution. Such means could, for example, include controlling the release of any inorganic perhydrate salt, acting as a hydrogen peroxide source, to the wash solution.

Suitable controlled release means can include coating any suitable component with a coating designed to provide the controlled release. The coating may therefore, for example, comprise a poorly water soluble material, or be a coating of sufficient thickness that the kinetics of dissolution of the thick coating provide the controlled rate of release.

The coating material may be applied using various methods. Any coating material is typically present at a weight ratio of coating material to bleach of from 1:99 to 1:2, preferably from 1:49 to 1:9.

Suitable coating materials include triglycerides (e.g. partially) hydrogenated vegetable oil, soy bean oil, cotton seed oil) mono or diglycerides, microcrystalline waxes, gelatin, cellulose, fatty acids and any mixtures thereof.

Other suitable coating materials can comprise the alkali and alkaline earth metal sulphates, silicates and carbonates, including calcium carbonate and silicas.

A preferred coating material, particularly for an inorganic perhydrate salt bleach source, comprises sodium silicate of $SiO_2$:$Na_2O$ ratio from 1.8:1 to 3.0:1, preferably 1.8:1 to 2.4:1, and/or sodium metasilicate, preferably applied at a level of from 2% to 10%, (normally from 3% to 5%) of $SiO_2$ by weight of the inorganic perhydrate salt. Magnesium silicate can also be included in the coating.

Any inorganic salt coating materials may be combined with organic binder materials to provide composite inorganic salt/organic binder coatings. Suitable binders include the $C_{10}$–$C_{20}$ alcohol ethoxylates containing from 5–100 moles of ethylene oxide per mole of alcohol and more preferably the $C_{15}$–$C_{20}$ primary alcohol ethoxylates containing from 20–100 moles of ethylene oxide per mole of alcohol.

Other preferred binders include certain polymeric materials. Polyvinylpyrrolidones with an average molecular weight of from 12,000 to 700,000 and polyethylene glycols (PEG) with an average molecular weight of from 600 to $5\times10^6$ preferably 1000 to 400,000 most preferably 1000 to 10,000 are examples of such polymeric materials. Copolymers of maleic anhydride with ethylene, methylvinyl ether or methacrylic acid, the maleic anhydride constituting at least 20 mole percent of the polymer are further examples of polymeric materials useful as binder agents. These polymeric materials may be used as such or in combination with solvents such as water, propylene glycol and the above mentioned $C_{10}$–$C_{20}$ alcohol ethoxylates containing from 5–100 moles of ethylene oxide per mole. Further examples of binders include the $C_{10}$–$C_{20}$ mono- and diglycerol ethers and also the $C_{10}$–$C_{20}$ fatty acids.

Cellulose derivatives such as methylcellulose, carboxymethylcellulose and hydroxyethylcellulose, and homo- or co-polymeric polycarboxylic acids or their salts are other examples of binders suitable for use herein.

One method for applying the coating material involves agglomeration. Preferred agglomeration processes include the use of any of the organic binder materials described hereinabove. Any conventional agglomerator/mixer may be used including, but not limited to pan, rotary drum and vertical blender types. Molten coating compositions may also be applied either by being poured onto, or spray atomized onto a moving bed of bleaching agent.

Other means of providing the required controlled release include mechanical means for altering the physical characteristics of the bleach to control its solubility and rate of release. Suitable protocols could include compaction, mechanical injection, manual injection, and adjustment of the solubility of the bleach compound by selection of particle size of any particulate component.

Whilst the choice of particle size will depend both on the composition of the particulate component, and the desire to meet the desired controlled release kinetics, it is desirable that the particle size should be more than 500 micrometers, preferably having an average particle diameter of from 800 to 1200 micrometers.

Additional protocols for providing the means of controlled release include the suitable choice of any other components of the detergent composition matrix such that when the composition is introduced to the wash solution the ionic strength environment therein provided enables the required controlled release kinetics to be achieved.

Optional Detergent Ingredients

In addition to the essential ingredients described hereinabove, the compositions of the invention may be formulated to comprise detergent ingredients, preferably selected from builder compounds, sources of alkalinity, surfactants, heavy metal ion sequestrants, crystal growth inhibitors, enzymes, organic polymeric compounds, and suds suppressors.

Water-Soluble Builder Compound

The compositions of the present invention may contain as a highly preferred component a water-soluble builder compound, typically present at a level of from 1% to 80% by weight, preferably from 10% to 70% by weight, most preferably from 20% to 60% by weight of the composition.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, carbonates, bicarbonates, borates, phosphates, and mixtures of any of the foregoing.

The carboxylate or polycarboxylate builder can be monomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Alicyclic and heterocyclic polycarboxylates include cyclopentane-cis, cis, cis-tetracarboxylates, cyclopentadienide pentacarboxylates, 2,3,4,5-tetrahydrofuran-cis, cis, cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions can also be used but are not preferred at wash conditions less that about 50° C., especially less than about 40° C.

Examples of carbonate builders are the alkaline earth and alkali metal carbonates, including sodium carbonate and sesqui-carbonate and mixtures thereof with ultra-fine calcium carbonate as disclosed in German Patent Application No. 2,321,001 published on Nov. 15, 1973.

Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Partially Soluble or Insoluble Builder Compound

The compositions of the present invention may less preferably contain a partially soluble or insoluble builder compound. Examples of partially water soluble builders include the crystalline layered silicates as disclosed for example, in EP-A-0164514, DE-A-3417649 and DE-A-3742043. Examples of largely water insoluble builders include the sodium aluminosilicates, including Zeolite A, Zeolite B, Zeolite P, Zeolite X, Zeolite MAP, Zeolite HS and mixtures thereof.

Alkalinity System

The compositions preferably contain an alkalinity system containing sodium silicate having an $SiO_2$:$Na_2O$ ratio of from 1.8 to 3.0, preferably from 1.8 to 2.4, most preferably 2.0, present preferably at a level of less than 20%, preferably from 1% to 15%, most preferably from 3% to 12% by weight of $SiO_2$. The alkali metal silicate may be in the form of either the anhydrous salt or a hydrated salt.

The alkalinity system also preferably contains sodium metasilicate, present at a level of at least 0.4% $SiO_2$ by weight. Sodium metasilicate has a nominal $SiO_2$:$Na_2O$ ratio of 1.0. The weight ratio of said sodium silicate to said sodium metasilicate, measured as $SiO_2$, is preferably from 50:1 to 5:4, more preferably from 15:1 to 2:1, most preferably from 10:1 to 5:2.

Surfactant

A highly preferred component of the compositions of the invention is a surfactant system comprising surfactant selected from anionic, cationic, nonionic ampholytic and zwitterionic surfactants and mixtures thereof. Automatic dishwashing machine products should be low foaming in character and thus the foaming of the surfactant system must be suppressed or more preferably be low foaming, typically nonionic in character. The surfactant system is typically present at a level of from 0.2% to 30% by weight, more preferably from 0.5% to 10% by weight, most preferably from 1% to 5% by weight of the compositions.

A typical listing of anionic, nonionic, ampholytic and zwitterionic classes, and species of these surfactants, is given in U.S. Pat. No. 3,929,678 issued to Laughlin and Heuring on Dec. 30, 1975. A list of suitable cationic surfactants is given in U.S. Pat. No. 4,259,217 issued to Murphy on Mar. 31, 1981. A listing of surfactants typically included in automatic dishwashing detergent compositions is given for example, in EP-A-0414 549 and PCT Applications No.s WO 93/08876 (attorney's docket no. CM465M) and WO 93/08874 (attorney's docket no. CM595M).

Nonionic Surfactant

Essentially any nonionic surfactants useful for detersive purposes can be included in the compositions. Preferred, non-limiting classes of useful nonionic surfactants are listed below.

Nonionic Ethoxylated Alcohol Surfactant

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 2 to about 10 moles of ethylene oxide per mole of alcohol.

Nonionic Ethoxylated/Propoxylated Fatty Alcohol Surfactant

The ethoxylated $C_6$–$C_{18}$ fatty alcohols and $C_6$–$C_{18}$ mixed ethoxylated/propoxylated fatty alcohols are suitable surfactants for use herein, particularly where water soluble. Preferably the ethoxylated fatty alcohols are the $C_{10}$–$C_{18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

Nonionic EO/PO Condensates with Propylene Glycol

The condensation products of ethylene oxide with a hydrophobic base formed by the condensation of propylene oxide with propylene glycol are suitable for use herein. The hydrophobic portion of these compounds preferably has a molecular weight of from about 1500 to about 1800 and exhibits water insolubility. Examples of compounds of this type include certain of the commercially-available Pluronic™ surfactants, marketed by BASF.

Nonionic EO Condensation Products with Propylene Oxide/Ethylene Diamine Adducts

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from about 2500 to about 3000. Examples of this type of nonionic surfactant include certain of the commercially available Tetronic™ compounds, marketed by BASF.

Heavy Metal Ion Sequestrant

The detergent compositions of the invention preferably contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 20%, preferably from 0.1% to 10%, more preferably from 0.25% to 7.5% and most preferably from 0.5% to 5% by weight of the compositions.

Heavy metal ion sequestrants, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water soluble. The molar ratio of said counter cation to the heavy metal ion sequestrant is preferably at least 1:1.

Suitable heavy metal ion sequestrants for use herein include organo amino phosphonates, such as the amino alkylene poly (alkylene phosphonates) and nitrilo trimethylene phosphonates. Preferred among the above species are diethylene triamine penta (methylene phosphonate), ethylene diamine tri (methylene phosphonate), and hexamethylene diamine tetra (methylene phosphonate).

Other suitable heavy metal ion sequestrant for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof.

Especially preferred is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt or complex thereof.

Crystal Growth Inhibitor Component

The detergent compositions preferably contain a crystal growth inhibitor component, preferably an organodiphosphonic acid component, incorporated preferably at a level of from 0.01% to 5%, more preferably from 0.1% to 2% by weight of the compositions.

By organo diphosphonic acid it is meant herein an organo diphosphonic acid which does not contain nitrogen as part of its chemical structure. This definition therefore excludes the organo aminophosphonates, which however may be included in compositions of the invention as heavy metal ion sequestrant components.

The organo diphosphonic acid is preferably a $C_1$–$C_4$ diphosphonic acid, more preferably a $C_2$ diphosphonic acid, such as ethylene diphosphonic acid, or most preferably ethane 1-hydroxy-1,1-diphosphonic acid (HEDP) and may be present in partially or fully ionized form, particularly as a salt or complex.

Enzyme

Another optional ingredient useful in the compositions is one or more enzymes. Preferred enzymatic materials include the commercially available lipases, amylases, neutral and alkaline proteases, esterases, cellulases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl and BAN by Novo Industries A/S. Amylase enzyme may be incorporated into the composition in accordance with the invention at a level of from 0.0001% to 2% active enzyme by weight of the composition.

Lipolytic enzyme (lipase) may be present at levels of active lipolytic enzyme of from 0.0001% to 2% by weight, preferably 0.001% to 1% by weight, most preferably from 0.001% to 0.5% by weight of the compositions. The lipase may be fungal or bacterial in origin. Lipase from chemically or genetically modified mutants of these strains are also useful herein. A preferred lipase is described in Granted European Patent, EP-B-0218272.

An especially preferred lipase herein is obtained by cloning the gene-from *Humicola lanuginosa* and expressing the gene in *Aspergillus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Enzyme Stabilizing System

Preferred enzyme-containing compositions herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, chlorine bleach scavengers and mixtures thereof. Such stabilizing systems can also comprise reversible enzyme inhibitors, such as reversible protease inhibitors.

Organic Polymeric Compound

Organic polymeric compounds may be added as preferred components of the compositions in accord with the invention. By organic polymeric compound it is meant essentially any polymeric organic compound commonly used as dispersants, and anti-redeposition and soil suspension agents in detergent compositions.

Organic polymeric compound is typically incorporated in the detergent compositions of the invention at a level of from 0.1% to 30%, preferably from 0.5% to 15%, most preferably from 1% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of molecular weight 2000–10000 and their copolymers with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Preferred are the copolymers of acrylic acid and maleic anhydride having a molecular weight of from 20,000 to 100,000.

Preferred commercially available acrylic acid containing polymers having a molecular weight below 15,000 include those sold under the tradename Sokalan PA30, PA20, PA15, PA10 and Sokalan CP10 by BASF GmbH, and those sold under the tradename Acusol 45N by Rohm and Haas.

Preferred acrylic acid containing copolymers include those which contain as monomer units: a) from 90% to 10%, preferably from 80% to 20% by weight acrylic acid or its salts and b) from 10% to 90%, preferably from 20% to 80% by weight of a substituted acrylic monomer or its salts having the general formula —[$CR_2$–$CR_1$(CO—O—$R_3$)]— wherein at least one of the substituents $R_1$, $R_2$ or $R_3$, preferably $R_1$ or $R_2$ is a 1 to 4 carbon alkyl or hydroxyalkyl group, $R_1$ or $R_2$ can be a hydrogen and $R_3$ can be a hydrogen or alkali metal salt. Most preferred is a substituted acrylic monomer wherein $R_1$ is methyl, $R_2$ is hydrogen (i.e. a methacrylic acid monomer). The most preferred copolymer of this type has a molecular weight of 3500 and contains 60% to 80% by weight of acrylic acid and 40% to 20% by weight of methacrylic acid.

The polyamino compounds are useful herein including those derived from aspartic acid such as those disclosed in EP-A-305282, EP-A-305283 and EP-A-351629.

Lime Soap Dispersant Compound

The compositions of the invention may contain a lime soap dispersant compound, preferably present at a level of from 0.1% to 40% by weight, more preferably 1% to 20% by weight, most preferably from 2% to 10% by weight of the compositions.

A lime soap dispersant is a material that prevents the precipitation of alkali metal, ammonium or amine salts of fatty acids by calcium or magnesium ions. Preferred lime soap disperant compounds are disclosed in PCT Application No. WO93/08877 (attorney's docket no. CM466M).

Suds Suppressing System

The compositions of the invention, when formulated for use in machine washing compositions, preferably comprise a suds suppressing system present at a level of from 0.01% to 15%, preferably from 0.05% to 10%, most preferably from 0.1% to 5% by weight of the composition.

Suitable suds suppressing systems for use herein may comprise essentially any known antifoam compound, including, for example silicone antifoam compounds, 2-alkyl and alcanol antifoam compounds. Preferred suds suppressing systems and antifoam compounds are disclosed in PCT Application No. WO93/08876 (attorney's docket no. CM465M) and copending European Application No. 93870132.3 (attorney's docket no. CM562F).

Polymeric Dye Transfer Inhibiting Agents

The compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof.

pH of the Compositions

The present compositions are preferably not formulated to have an unduly high pH, in preference having a pH measured as a 1% solution in distilled water of from 8.0 to 12.0, more preferably from 9.0 to 11.8, most preferably from 9.5 to 11.5.

Form of the Compositions

The compositions of the invention can be formulated in any desirable form such as powders, granulates, pastes, liquids, gels and tablets, granular forms being preferred.

The bulk density of the granular detergent compositions in accordance with the present invention is typically of at least 650 g/litre, more usually at least 700 g/litre and more preferably from 800 g/litre to 1200 g/litre.

The particle size of the components of granular compositions in accordance with the invention should preferably be such that no more that 5% of particles are greater than 1.4 mm in diameter and not more than 5% of particles are less than 0.15 mm in diameter.

Generally, if the compositions are in liquid form the liquid should be thixotropic (ie; exhibit high viscosity when subjected to low stress and lower viscosity when subjected to high stress), or at least have very high viscosity, for example, of from 1,000 to 10,000,000 centipoise.

Machine Dishwashing Method

Any suitable methods for machine washing or cleaning soiled tableware, particularly soiled silverware are envisaged.

A preferred machine dishwashing method comprises treating soiled articles selected from crockery, glassware, hollowware, silverware and cutlery and mixtures thereof, with an aqueous liquid having dissolved or dispensed therein an effective amount of a machine dishwashing composition in accord with the invention. By an effective amount of the machine dishwashing composition it is meant from 8 g to 60 g of product dissolved or dispersed in a wash solution of volume from 3 to 10 litres, as are typical product dosages and wash solution volumes commonly employed in conventional machine dishwashing methods.

Silver Treatment Method

In another aspect of the invention it has been found that treatment of silverware with a composition containing a water-soluble bismuth compound prior to washing in a conventional machine dishwashing method employing an oxygen bleach-containing product can also reduce the tendency of that silverware to tarnish during the wash.

More generally, such treatment of the silverware can also reduce atmospheric tarnishing of the silverware.

Said treatment may for example, take the form of soaking the silverware in a solution containing a water-soluble bismuth salt or alternatively it may be achieved by applying a silver treatment composition containing a water-soluble bismuth salt to the silverware. Such application may for example be achieved by use of an applicator means such as a brush, spray, or cloth, which may be followed for example, by manual rubbing or polishing steps.

The silver treatment composition may be formulated to contain detergent components such as surfactants and builders, including any of those described hereinbefore. It may also comprise additional corrosion inhibitor compounds. Pasty silver treatment compositions can be formulated to include insoluble inorganic compounds such as diatomite, siliceous chalk or vienna lime in combination with thiourea, organic acids and suspension agents. Other suitable components include any of those disclosed in German Patent Application No. DE-A-2539956.

'Through the Wash' Bismuth Delivery Methods

In yet another aspect it has been found that the provision of a means of delivering bismuth ions to a machine silverware pre-rinsing or washing/bleaching solution which is not integral with the bleaching/detergent composition employed therein can also lead to a reduction in the tendency for silver tarnishing to occur during the course of the machine rinsing or dishwashing process.

Said means can include some kind of a bismuth ion delivery system placed inside a dishwasher machine which is designed to allow release of bismuth ions during the course of the washing process. The delivery system could for example, be a mechanical delivery system. Alternatively it might take the form of a block of poorly water-soluble material impregnated with a water-soluble bismuth salt, which is suspended in the interior of the dishwasher machine. Materials similar to those used in the formation of commonly known 'toilet blocks' could find utility in this execution.

In the compositions, the abbreviated component identifications have the following meanings:

Nonionic: $C_{13}$–$C_{15}$ mixed ethoxylated/propoxylated fatty alcohol with an average degree of ethoxylation of 3.8 and an average degree of propoxylation of 4.5 sold under the tradename Plurafac LF404 by BASF Gmbh (low foaming)

Metasilicate : Sodium metasilicate ($SiO_2$: $Na_2O$ ratio=1.0)

Silicate: Amorphous Sodium Silicate ($SiO_2$: $Na_2O$ ratio= 2.0)

Carbonate: Anhydrous sodium carbonate

Phosphate: Sodium tripolyphosphate

480N: Random copolymer of 3:7 acrylic/methacrylic acid, average molecular weight about 3,500

Citrate: Tri-sodium citrate dihydrate

PB1: Anydrous sodium perborate monohydrate

TAED: Tetraacetyl ethylene diamine

Cationic precursor Cationic peroxyacid bleach precursor salt of trialkyl ammonium methylene $C_5$-alkyl caprolactam with tosylate BzP: Dibenzoyl peroxide DETPMP: Diethylene triamine penta (methylene phosphonic acid), marketed by Monsanto under the tradename Dequest 2060

HEDP: Ethane 1-hydroxy-1,1-diphosphonic acid

PMT: 1-phenyl-5-mercapto-1,2,3,4-tetrazole

Bismuth nitrate: Bismuth nitrate salt

Paraffin: Paraffin oil sold under the tradename Winog 70 by Wintershall.

BD/MA: Copolymer of butadiene/maleic acid as sold by Polysciences inc under the tradename reference no. 07787

Protease: Proteolytic enzyme sold under the tradename Savinase by Novo Industries A/S (approx 2% enzyme activity).

Amylase: Amylolytic enzyme sold under the tradename Termamyl 60T by Novo Industries A/S (approx 0.9% enzyme activity)

BSA: Amylolytic enzyme sold under the tradename LE17 by Novo Industries A/S (approx 1% enzyme activity)

Sulphate: Anhydrous sodium sulphate.

pH: Measured as a 1% solution in distilled water at 20° C.

In the following examples all levels of enzyme quoted are expressed as % active enzyme by weight of the composition.

Example 1

The following bleach-containing machine dishwashing compositions were prepared (parts by weight). Compositions A is a comparative composition, compositions B to G are in accord with the invention.

| | A | B | C | D | E | F | G |
|---|---|---|---|---|---|---|---|
| Citrate | 15.0 | 15.0 | 15.0 | 15.0 | 15.0 | 15.0 | — |
| 480N | 6.0 | 6.0 | 6.0 | 6.0 | 6.0 | 6.0 | — |
| Carbonate | 17.5 | 17.5 | 17.5 | 17.5 | 17.5 | 17.5 | — |
| Phosphate | — | — | — | — | — | — | 38.0 |
| Silicate (as $SiO_2$) | 8.0 | 8.0 | 8.0 | 8.0 | 8.0 | 8.0 | 14.0 |
| Metasilicate (as $SiO_2$) | 1.2 | 1.2 | 1.2 | 1.2 | 1.2 | 1.2 | 2.5 |

-continued

| | A | B | C | D | E | F | G |
|---|---|---|---|---|---|---|---|
| PB1 (AvO) | 1.2 | 1.2 | 1.5 | 1.5 | 1.5 | 2.2 | 1.2 |
| TAED | 2.2 | 2.2 | 2.2 | — | — | 2.2 | 2.2 |
| BzP | — | — | — | 0.8 | — | — | — |
| Cationic precursor | — | — | — | — | 3.3 | — | — |
| Paraffin | 0.5 | 0.5 | 0.5 | 0.5 | 0.5 | 0.5 | 0.5 |
| Bismuth nitrate | — | 0.2 | 0.2 | 0.2 | 0.3 | 0.4 | 0.2 |
| BD/MA | — | — | — | — | — | — | 0.5 |
| PMT | — | — | — | — | — | — | 0.5 |
| Protease | 0.04 | 0.04 | 0.04 | 0.04 | 0.04 | 0.04 | 0.04 |
| Amylase | 0.03 | 0.03 | 0.03 | 0.03 | 0.03 | 0.03 | — |
| BSA | — | — | — | — | — | — | 0.03 |
| DETPMP | 0.13 | 0.13 | 0.13 | 0.13 | 0.13 | 0.13 | — |
| HEDP | 1.0 | 1.0 | 1.0 | 1.0 | 1.0 | 1.0 | — |
| Nonionic | 2.0 | 2.0 | 2.0 | 2.0 | 2.0 | 2.0 | 1.5 |
| Sulphate | 23.0 | 22.8 | 22.4 | 22.7 | 22.2 | 21.5 | 0.3 |
| misc inc moisture to balance | | | | | | | |
| pH (1% solution) | 10.7 | 10.7 | 10.7 | 10.7 | 10.7 | 10.7 | 11.0 |

Comparative Testing—Silver Tarnishing

The silver tarnish prevention performance of Compositions B to F, in accord with the invention was compared to that of comparative Composition A using the following twenty cycle test procedure. A set of three silver spoons were placed in the cutlery basket of each of four Phillips (tradename) machine dishwashers. Twenty grams of background soil, comprising 1 part by weight of each of Prince's (tradename) tinned stewing steak, Heinz (tradename) tinned baked beans and Ambrosia (tradename) tinned creamed rice, well mixed together, was added to each dishwasher by placing the soil in a 50 $cm^3$ plastic beaker which was stood inverted in the upper rack of the dishwasher. A spike comprising 10 $cm^3$ of 0.262% by weight $CaCl_2 \cdot {}_6H_2O$ solution was added by pipette to the bottom of each dishwasher. The 65° C. wash setting was selected, the wash process comprising main wash and rinse cycles. 20 grams of each composition was employed for each complete wash process. The feed water hardness was 8° Clark Hardness (114.3 ppm $CaCO_3$ equivalent). Each set of three spoons was washed five times in each of the four machines (ie: 20 complete wash+rinse cycles).

At the end of the final wash process the spoons were removed and then graded for silver tarnishing. The grading was performed by 4 expert graders and the results averaged for each of the four sets of three spoons. Grading was through visual inspection according to the following scale:

0=no tarnish (shiny silver)

1=very slight tarnish

2=tarnish

3=very tarnished

4=severe tarnish (black coverage)

Results were as follows: (average of the 4 gradings from the panellists)

| Composition | A | B | C | D | E | F |
|---|---|---|---|---|---|---|
| Tarnish grade | 2.0 | 0.5 | 0.5 | 0.5 | 0.5 | 0.5 |

Comparison of the grade obtained for Composition A with that obtained for Compositions B to F shows that less silver tarnishing is obtained for the compositions in accord with the invention, even though each of Compositions C to F has a higher level of oxygen bleach (AvO) than that of Composition A.

We claim:

1. A composition, adapted for use in a machine dishwashing method, and having silver anti-tarnishing properties, comprising:

(a) an oxygen-releasing bleaching system;

(b) from 0.1% to 5% by weight of the composition of a water soluble bismuth compound; and (c) said composition being free of a chlorine bleach.

2. A composition according to claim 1 wherein said water-soluble bismuth compound is selected from the group consisting of the bismuth trihalides, bismuth nitrate and any mixtures thereof.

3. A composition according to claim 1 wherein said water-soluble bismuth compound comprises a salt or a complex with a chelating organic ligand.

4. A composition according to claim 3 wherein said chelating organic ligand is a heavy metal ion sequestrant.

5. A composition according to claim 3, wherein said chelating organic ligand is a polycarboxylate builder compound.

6. A composition according to claim 1 containing a water-soluble sulphate salt at a level of from 0.1% to 40% by weight of the composition.

7. A composition according to claim 6 wherein said water-soluble sulphate salt is selected from the sulphates of the alkali and alkaline earth metals.

8. A composition according to claim 1 wherein said oxygen-releasing bleaching system comprises a hydrogen peroxide source and a peroxyacid bleach precursor compound.

9. A composition according to claim 8 wherein said hydrogen peroxide source comprises an inorganic perhydrate salt.

10. A composition according to claim 1 containing:

(a) from 10% to 70% by weight of the composition of a water soluble builder compound; and (b) from 0.5% to 10% by weight of the composition of a low foaming surfactant system.

11. A method for preventing tarnishing of silverware in machine dishwashing using an oxygen bleach-containing detergent composition, comprising the steps of:

adding from 0.1% to 5% by weight of the compostion of a water-soluble bismuth compound for the pretreatment of silverware to said oxygen bleach-containing detergent composition; and submitting said silverware to machine dishwashing thereafter.

12. A method for preventing tarnishing of silverware in machine dishwashing using an oxvgen bleach-containing detergent composition, comprising the steps of:

delivering from 0.1% to 5% by weight of the composition of bismuth ions to a machine dishwashing solution containing an oxygen bleach by means other than said oxygen bleach-containing detergent composition, said means consisting of a water-soluble bismuth compound.

13. A method for preventing tarnishing of silverware in machine dishwashing using an oxygen bleach-containing composition, comprising the steps of:

pretreating said silverware with from 0.1% to 5% by weight of the compostion of a water-soluble bismuth compound prior to submitting said silverware to machine dishwashing using said oxygen bleach-containing composition.

* * * * *